US008806790B1

(12) United States Patent
Huang et al.

(10) Patent No.: US 8,806,790 B1
(45) Date of Patent: Aug. 19, 2014

(54) AMBIDEXTROUS SAFETY SELECTOR FOR FIREARMS

(76) Inventors: George Huang, Henderson, NV (US); Roger Wang, Malibu, CA (US)

( * ) Notice: Subject to any disclaimer, the term of this patent is extended or adjusted under 35 U.S.C. 154(b) by 0 days.

(21) Appl. No.: 13/068,287

(22) Filed: May 7, 2011

Related U.S. Application Data

(60) Provisional application No. 61/400,643, filed on Jul. 31, 2010, provisional application No. 61/338,541, filed on Feb. 19, 2010.

(51) Int. Cl.
*F41A 17/74* (2006.01)
*F41A 17/56* (2006.01)
*F41A 17/64* (2006.01)

(52) U.S. Cl.
CPC ..... *F41A 17/74* (2013.01); *F41A 17/56* (2013.01); *F41A 17/64* (2013.01)
USPC ..... 42/70.08; 89/148

(58) Field of Classification Search
CPC ..... F41A 17/74; F41A 17/80; F41A 17/46; F41A 17/52; F41A 17/56; F41A 17/62; F41A 17/64; F41A 17/70
USPC ..... 42/70.05, 70.08, 70.04, 70.06; 89/142, 89/148, 150
See application file for complete search history.

(56) References Cited

U.S. PATENT DOCUMENTS

| | | | | |
|---|---|---|---|---|
| 2,225,583 | A * | 12/1940 | Blizard | 42/70.06 |
| 3,442,173 | A * | 5/1969 | Muller | 89/127 |
| 3,949,508 | A * | 4/1976 | Elkas | 42/69.03 |
| 4,681,020 | A * | 7/1987 | Polanecky | 89/138 |
| 6,305,114 | B1 * | 10/2001 | Saltz | 42/70.08 |
| 7,313,996 | B2 * | 1/2008 | Werner | 89/181 |
| 8,276,502 | B1 * | 10/2012 | Wright | 89/148 |
| 2004/0144245 | A1 * | 7/2004 | Wonisch et al. | 89/196 |
| 2005/0229462 | A1 * | 10/2005 | McGarry | 42/70.08 |
| 2005/0241470 | A1 * | 11/2005 | Hochstrate et al. | 89/142 |

* cited by examiner

*Primary Examiner* — Stephen M Johnson
(74) *Attorney, Agent, or Firm* — Shaddock Law Group, PC

(57) ABSTRACT

Improved safety selectors for firearms, which are ambidextrous and come in a plurality of interchangeable lengths and thicknesses to enable a user to select those that they feel are most desirable.

20 Claims, 5 Drawing Sheets

AMBIDEXTROUS SAFETY SELECTOR FOR FIREARMS

RELATED CASES

This patent application claims the benefit of U.S. Patent Application Ser. No. 61/338,541, filed Feb. 19, 2010 and U.S. Patent Application Ser. No. 61/400,643, filed Jul. 31, 2010, the disclosures of which are incorporated herein in their entireties by reference.

FIELD OF INVENTION

The present disclosure relates generally to the field of firearms and is particularly directed to improved ambidextrous safety selectors for firearms, such as the M-16 and the like.

BACKGROUND

It is well known that all modern firearms are provided with a safety selector, which includes a lock member mounted within the breech portion of the firearm and movable between a "SAFE" position, in which the lock member blocks movement of a portion of the weapon's firing mechanism, such as the hammer, and a "FIRE" position, which allows firing of the weapon. The lock member is actuated by a safety selector, mounted on the outside of the weapon, and connected to the lock member to move the lock member between the "SAFE" and "FIRE" positions. As manufactured, modern weapons are provided with a safety selector on the right side of the weapon, since most people are right-handed.

However, this is extremely inconvenient for left-handed people to operate. Also, the standard size of the safety selector for the M-16 is about one inch in length and about ¼ inch in width and thickness. While this size makes the safety selector easy to locate and move, it, unfortunately, makes it very easy for the selector to catch the web of skin between the user's thumb and forefinger, which is painful and can interfere with actuation of the selector. Also, due to the size and bulk of the safety selector, many right-handed users find it annoying, since it underlies the trigger finger and can be uncomfortable.

Modifications have been proposed for replacing the manufacturer's safety mechanism with an ambidextrous device having safety selectors provided on both sides of the weapon to accommodate both left- and right-handed people. However, the modifications of the prior art have usually provided safety selectors on both sides of the weapon, but of the same dimensions as the manufacturer's safety selector. This merely multiplies the disadvantages mentioned above.

It has also been proposed to provide a shortened safety selector of approximately ½ inch. This reduces the likelihood of catching the user's skin, but does little to improve the bulkiness of the safety selector. Thus, none of the prior art safety selectors have been entirely satisfactory.

BRIEF SUMMARY AND OBJECTS OF INVENTION

These disadvantages of the prior art are overcome with the present invention and ambidextrous safety selectors are provide, which allow the user to choose a safety selector that they feel is comfortable and convenient, yet is easy to identify and use.

These advantages of the present invention are preferably attained by providing a plurality of interchangeable ambidextrous safety selectors in a variety of lengths and thicknesses, which allow the user to select and install the ones that they feel are most desirable.

Accordingly, it is an object of the present invention to provide improved safety selectors for firearms.

Another object of the present invention is to provide improved safety selectors for firearms, which selectors are ambidextrous.

An additional object of the present invention is to provide improved safety selectors for firearms, which selectors are ambidextrous and interchangeable.

Another object of the present invention is to provide improved safety selectors for firearms, which selectors are ambidextrous and come in a plurality of interchangeable sizes to enable the user to select those that they feel are most desirable.

A specific object of the present invention is to provide improved safety selectors for firearms, which selectors are ambidextrous and come in a plurality of interchangeable lengths and thicknesses to enable the user to select those that they feel are most desirable.

These and other objects and features of the present invention will be apparent from the following detailed description, taken with reference to the figures of the accompanying drawing.

DETAILED DESCRIPTION OF THE INVENTION

Figure 1:
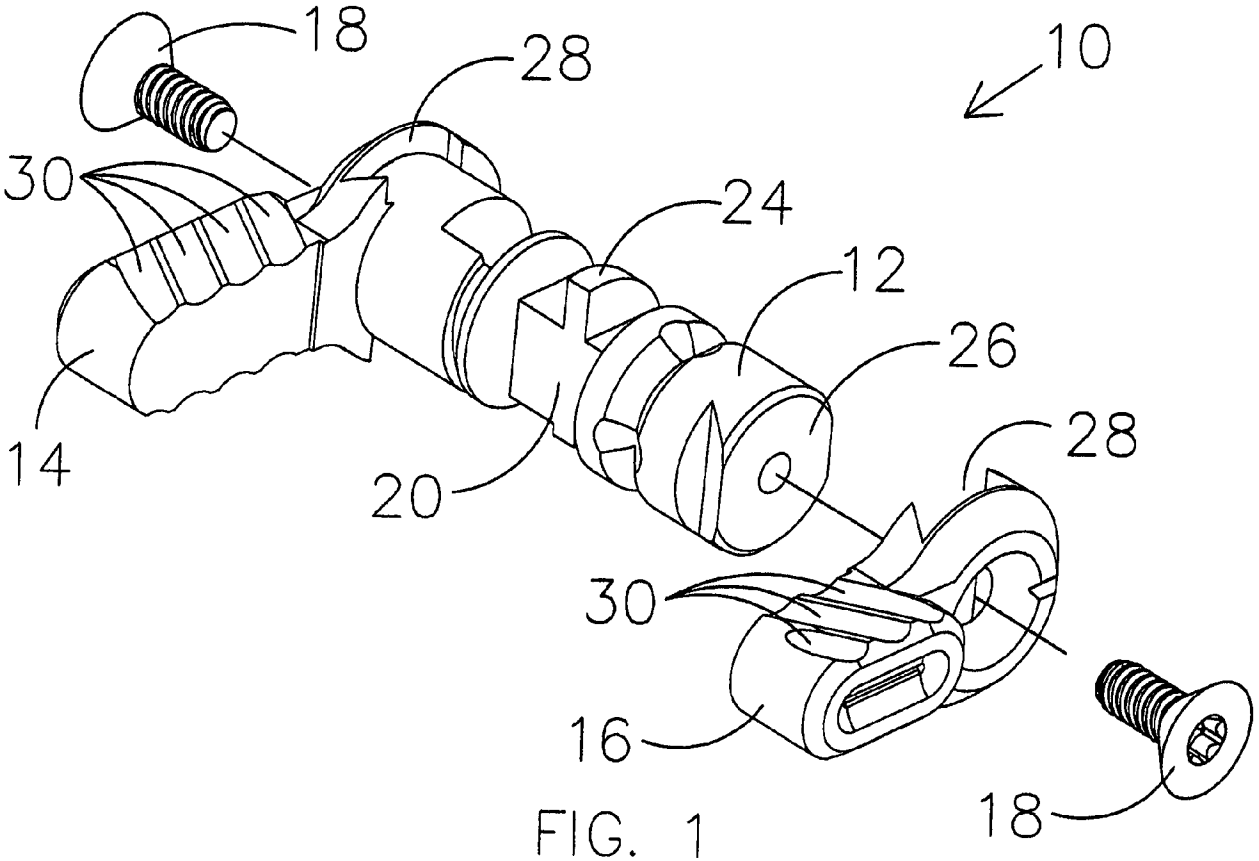
FIG. 1 is an exploded view of a safety selector for an M16 rifle embodying the present invention.
Figure 2:
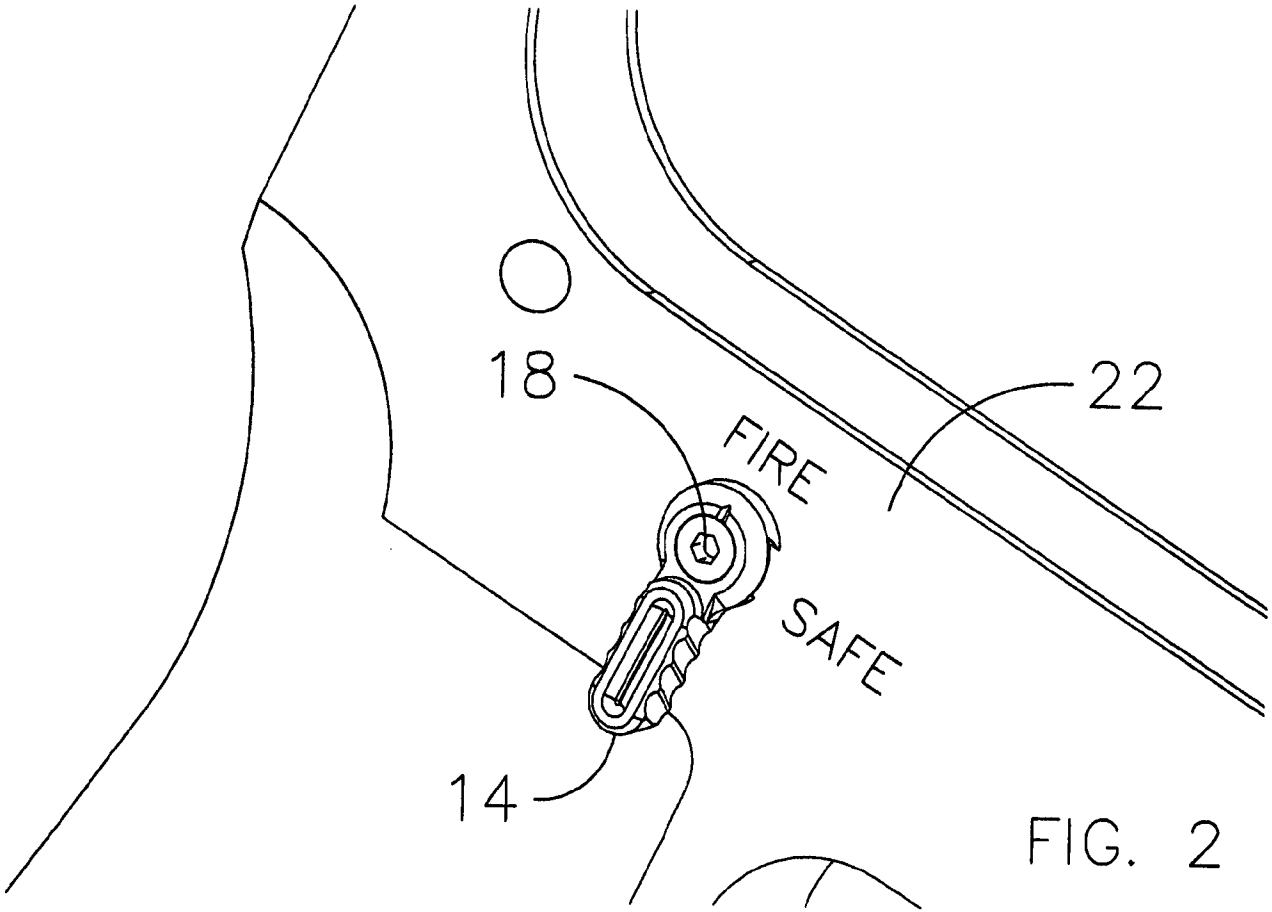
FIG. 2 is a side view of the breech section of an M-16 showing the standard issue safety selector in the "FIRE" position.
Figure 3:
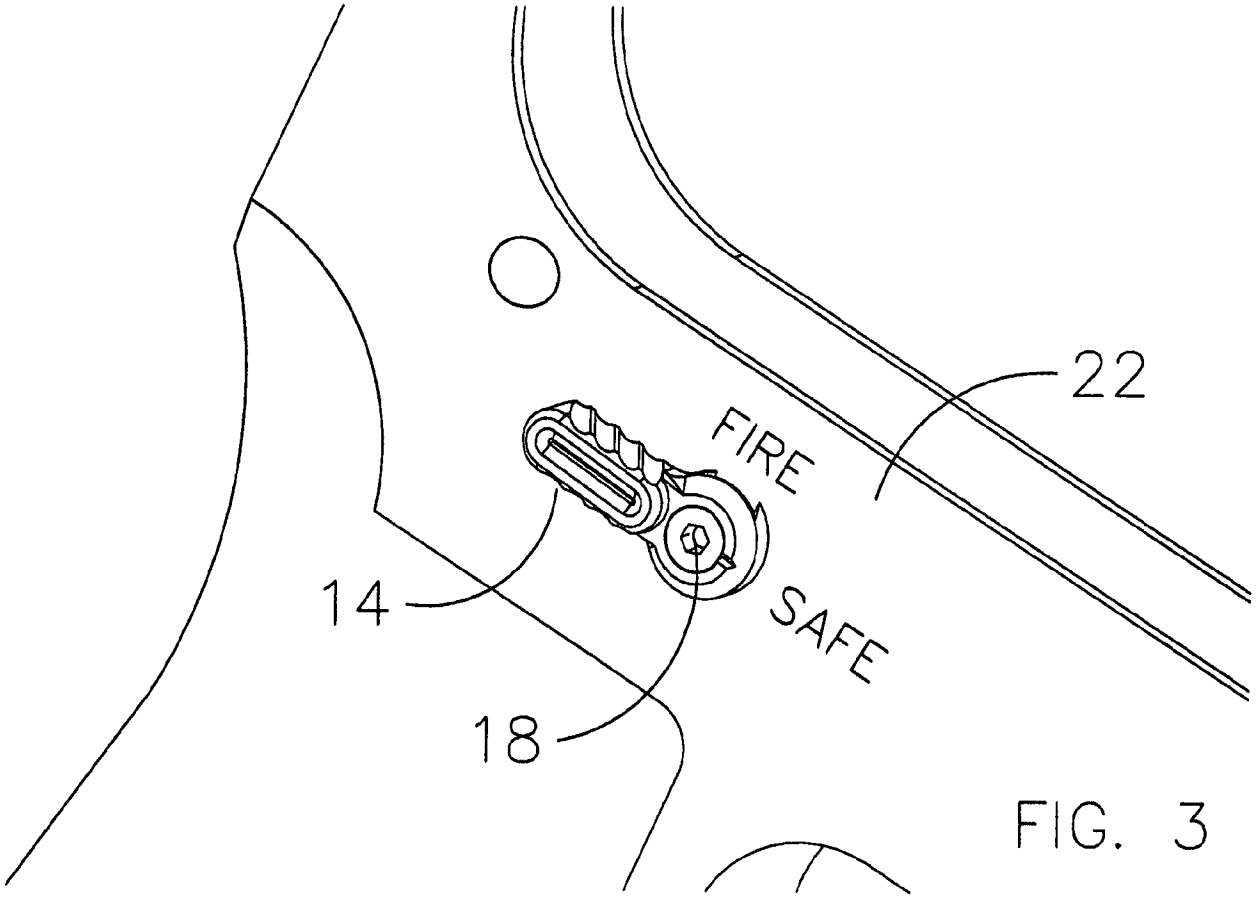
FIG. 3 is a view of the safety selector of FIG. 2 shown in the "SAFE" position.

In that form of the present invention chosen for purposes of illustration, FIG. 1 shows an exploded view of a safety selector, indicated generally at 10 removed from a rifle and comprising a lock member 12 and a pair of lever members 14 and 16 secured to opposing ends of the lock member 12 by suitable means, such as screws 18. The lock member 12 is formed with a solid portion 24 and a central recess 20. The safety selector 10 is mounted in a rifle 22, as seen in FIG. 2, and is rotatable between a "FIRE" position, as shown in FIG. 2, and a "SAFE" position, as shown in FIG. 3. When the safety selector 10 is in the "SAFE" position, the solid portion 24 of the lock member protrudes into the path of a movable member of the rifle's firing mechanism, such as the hammer, not shown. However, when the safety selector 10 is rotated to the "FIRE" position, the recess 20 is positioned to allow free movement of the firing mechanism. Also, as seen at 26 in FIG. 1, the lock member 12 has projections 26 formed in each end of the lock member 12 and the lever members 14 and 16 are formed with recesses 28, which mate with the projections 26 to ensure that the lock member 12 is rotated with the lever member 14 or 16.

Prior art safety selectors have been attached solely by screws. However, repeated movement of the safety selectors applies torque and sheering forces to the screws, which tends to strip the screws, allowing the safety selector to detach or fall off, rendering the safety inoperable and useless. The recessed design of the present invention provides a very solid attachment in which the screws 18 simply prevent the levers 14 and 16 from sliding along the recesses 26 and are subject to no additional stress as the levers 14 and 16 are moved.

As issued, the safety selector 10 has a lever member, such as lever member 14, located only on the left side of the rifle, which is inconvenient for left-handed shooters. Also, the standard lever member is approximately 1 inch in length and approximately ¼ inch in thickness. Unfortunately, this thickness can bear against the shooter's flesh and can be quite uncomfortable. Also, this length makes it quite easy for the lever member to snag the web of skin between the shooter's thumb and forefinger, which is extremely painful and, under combat conditions, can easily become infected, which can lead to serious or even fatal consequences. On the other hand, some shooters prefer a lever member of this length as being easy to locate and rotate.

To overcome these difficulties, the present invention proposes to provide lever members on each side of the rifle, as seen at 14 and 16 in FIG. 1. This makes the safety selector 10 conveniently operable by both right- and left-handed shooters. Furthermore, it is proposed to provide a plurality of interchangeable lever members 14 and 16 of different lengths and thicknesses to allow the shooter to select lever members 14 and 16, which are most satisfactory to the shooter.

Figure 4:
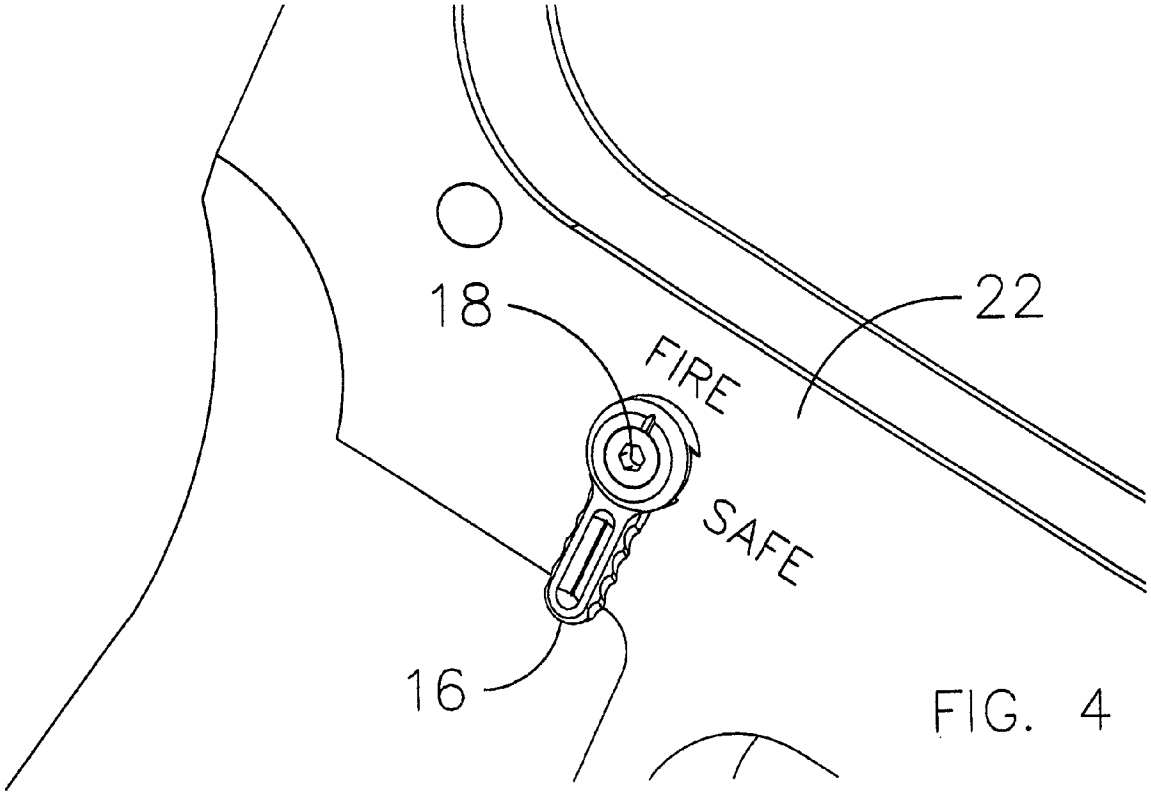
FIG. 4 is aside view of an alternative form of the safety selector of FIG. 3.
Figure 5:
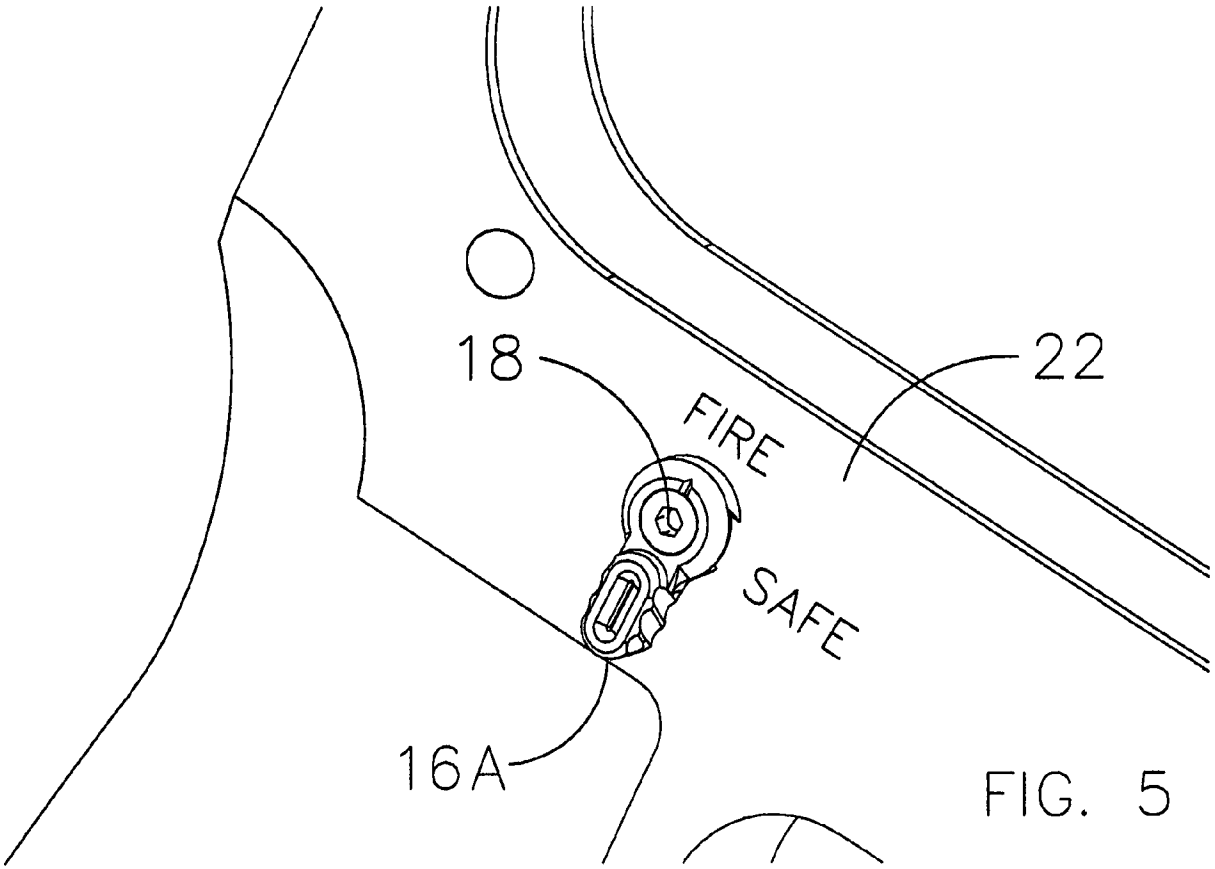
FIG. 5 is a side view of another alternative for of the safety selector of FIG. 3.

Thus, FIG. 4 shows a lever member 16, which has a thickness of only approximately 118 inch. This thinner lever member is much more comfortable when underlying the shooter's skin and yet is equally easy to locate to arm or disarm the weapon. Similarly, FIG. 5 shows a lever member 16A, which is only approximately ½ inch in length. This significantly reduces the likelihood of snagging the shooter's skin, which avoids the hazards associated with this problem. As noted above, the lever members 14, 16 and 16A may be mounted on each end of the lock member 12 and the lever members 14, 16 and 16A on one end of the lock member 12 may or may not match the lever member 14, 16 or 16A on the opposite end of the lock member 12.

It should also be noted that the levers 14, 16 and 16A are formed with a plurality of diagonal grooves 30. These grooves serve to prevent the user's finger from slipping off the lever 14, 16 or 16A and also serve to hold paint, which may be applied to the levers 14, 16 or 16A as is often done in training.

Obviously, numerous variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A safety selector comprising:

a generally cylindrical lock member having, a solid portion selectably rotatable to block movement of a portion of a firing mechanism of a weapon and having a projection selectably rotatable to allow such movement, said lock member having said projection formed on each end thereof; and at least two lever members, each lever member having a recess mateable with said projection of said lock member, wherein said lever members are interchangeable, wherein one of said lever members is secured to a first end of said lock member via interaction of said projection and said recess and is further secured to said first end of said lock member via a screw.

2. The safety selector of claim 1, wherein said lever members are approximately one inch in length and approximately ¼ inch in thickness.

3. The safety selector of claim 1, wherein said lever members are approximately ⅛ inch in thickness.

4. The safety selector of claim 1, wherein said lever members are approximately ½ inch in length.

5. The safety selector of claim 1, wherein a plurality of said lever members are provided.

6. The safety selector of claim 1, wherein said lever members are attached to both ends of said lock member.

7. The safety selector of claim 1, wherein said lever members are of different lengths.

8. The safety selector of claim 1, wherein said lever members are of different thicknesses.

9. The safety selector of claim 1, wherein said lever members include different lengths and thicknesses.

10. The safety selector of claim 1 wherein one of said lever members is secured to a second end of said lock member via interaction of said projection and said recess and is further secured to said second end of said lock member via a screw.

11. The safety selector of claim 1, wherein said recess in said lever member is dovetailed.

12. The safety selector of claim 1, wherein said lever member is formed with a plurality of diagonal grooves.

13. The safety selector of claim 1, wherein said lock member comprises at least one central recess formed proximate a central portion of said lock member and wherein said central recess includes at least one substantially planar portion positioned to allow movement of said firing mechanism when said lock member is rotated to a "FIRE" position.

14. A rifle safety selector comprising:

a generally cylindrical lock member having a portion selectably rotatable to block movement of a portion of a trigger mechanism of a weapon and having a dovetail projection formed on at least one end thereof, wherein said dovetail projection is selectably rotatable to rotate said lock member; and at least one lever member having a recess mateable with said dovetail projection of said lock member, wherein said at least one lever member is secured, via interaction of said dovetail projection and said recess, to said lock member.

15. The rifle safety selector of claim 14, wherein said lock member comprises a dovetail projection formed on each end thereof and at least two lever members, each having a recess mateable with at least one of said dovetail projections of said lock member, wherein each of said lever members is secured, via interaction of said dovetail projection and said recess, to one of said dovetail projections.

16. The rifle safety selector of claim 15, wherein each of said lever members is further secured to said lock member via a screw.

17. The rifle safety selector of claim 14, wherein said at least one lever member is further secured to said lock member via a screw.

18. A rifle safety selector comprising:

a generally cylindrical lock member having a portion selectably rotatable to block movement of a portion of a firing mechanism of a weapon and having a dovetail projection formed on each end thereof, wherein each of said dovetail projections is selectably rotatable to rotate said lock member; and at least two lever members, each having a recess mateable with at least one of said dovetail projections of said lock member, wherein each of said lever members is secured, via interaction of said dovetail projection and said recess, to one of said dovetail projections.

19. The rifle safety selector of claim 18, wherein each of said lever members is further secured to said lock member via a screw.

20. The rifle salty selector of claim 18, wherein each of said dovetail projections includes a receiving portion located proximate a periphery end of said dovetail projection.

* * * * *

UNITED STATES PATENT AND TRADEMARK OFFICE

CERTIFICATE OF CORRECTION

PATENT NO. : 8,806,790 B1
APPLICATION NO. : 13/068287
DATED : August 19, 2014
INVENTOR(S) : George Huang and Roger Wang It is certified that error appears in the above-identified patent and that said Letters Patent is hereby corrected as shown below:

In the Claims,

Claim 20, Column 5, Line 6, delete “rifle salty selector” and insert --rifle safety selector--.

Signed and Sealed this
Thirty-first Day of March, 2015

Michelle K. Lee

Michelle K. Lee
*Director of the United States Patent and Trademark Office*